US007108562B2

(12) United States Patent
Liao

(10) Patent No.: US 7,108,562 B2
(45) Date of Patent: Sep. 19, 2006

(54) SIMPLE PLUG CONVERTER STRUCTURE

(76) Inventor: Sheng Hsin Liao, No. 10, Alley 38, Lane 229, San Chun St., Shulin, Taipei Hsien (TW)

( * ) Notice: Subject to any disclaimer, the term of this patent is extended or adjusted under 35 U.S.C. 154(b) by 0 days.

(21) Appl. No.: 10/967,243

(22) Filed: Oct. 19, 2004

(65) Prior Publication Data

US 2006/0009083 A1 Jan. 12, 2006

(30) Foreign Application Priority Data

Jul. 6, 2004 (JP) ..... 2004-003976

(51) Int. Cl.
*H01R 24/00* (2006.01)

(52) U.S. Cl. ..... 439/676; 439/170; 439/177; 439/218

(58) Field of Classification Search ..... 439/676, 439/170, 177, 218
See application file for complete search history.

(56) References Cited

U.S. PATENT DOCUMENTS

| | | | | |
|---|---|---|---|---|
| 5,096,441 | A * | 3/1992 | Jaag | 439/676 |
| 5,238,426 | A * | 8/1993 | Arnett | 439/557 |
| 5,660,564 | A * | 8/1997 | Yamanashi et al. | 439/557 |
| 6,358,086 | B1 * | 3/2002 | Gallagher et al. | 439/538 |
| 6,537,099 | B1 * | 3/2003 | Herlinger et al. | 439/352 |
| 6,935,877 | B1 * | 8/2005 | Liao | 439/170 |

* cited by examiner

*Primary Examiner*—Truc Nguyen
(74) *Attorney, Agent, or Firm*—Rosenberg, Klein & Lee

(57) ABSTRACT

A simple plug converter structure includes an insulative housing being a plurality of slots formed at a front thereof, a plurality of contacts received in the slots respectively, a convertible member sleeved on the insulative housing and being capable of moving forwards and backwards; and at least one resilient member arranged between the insulative housing and the convertible member, so that the convertible member resiliently sleeves onto the insulative housing.

3 Claims, 16 Drawing Sheets

SIMPLE PLUG CONVERTER STRUCTURE

BACKGROUND OF THE INVENTION

1. Field of the Invention

The present invention relates to a simple plug converter structure, and particularly relates to a simple plug converter structure that can be applied with various specifications. The present application claims priority to Japanese Application Nos. 3976/2004 filed Jul. 6, 2004.

2. Background of the Invention

Referring to FIGS. 1A and 1B, a conventional plug electrically connecting a plurality of conductive wires is commonly used for computers or telephones. The conventional plug includes an insulative housing 10*a* and a buckling member 11*a* disposed on an outer surface of the insulative housing 10*a*. The insulative housing 10*a* has a plurality of contacts 12*a* received therein and moving short distances longitudinally. When a plurality of conductive wires 20*a* are inserted into the insulative housing 10*a* from a rear thereof for electrical connection, the contacts 12*a* pierce the conductive wires 20*a* in order to electrically connect to the inner conductor.

However, each conventional plug is equipped with different-sized insulative housing 10*a*, which width may be "a" or "b". Since the size of the insulative housing 10*a* is fixed for only a single specification, the conventional plug cannot be adapted for different standards, such as those with 6 pins or 8 pins. Therefore, a new-standard plug needs new processes with new sizes via new molds adding a heavy burden upon production costs.

Hence, an improvement over the prior art is required to overcome the disadvantages thereof.

SUMMARY OF INVENTION

The primary objective of the invention is therefore to specify a simple plug converter structure that can alter two standards with one single sized insulative housing, to save on manufacturing costs and to simplify the conversion processes.

According to the invention, the objective is achieved by a simple plug converter structure that includes an insulative housing, a plurality of contacts, a convertible member and at least one resilient member. The insulative housing has a plurality of slots formed at a front thereof. The contacts are received in the slots respectively. The convertible member is sleeved onto the insulative housing and can be moved forwards and backwards. The resilient member is arranged between the insulative housing and the convertible member, so that the convertible member resiliently sleeves onto the insulative housing.

To provide a further understanding of the invention, the following detailed description illustrates embodiments and examples of the invention. Examples of the more important features of the invention thus have been summarized rather broadly in order that the detailed description thereof that follows may be better understood, and in order that the contributions to the art may be appreciated. There are, of course, additional features of the invention that will be described hereinafter and which will form the subject of the claims appended hereto.

BRIEF DESCRIPTION OF THE DRAWINGS

These and other features, aspects, and advantages of the present invention will become better understood with regard to the following description, appended claims, and accompanying drawings, where:

DETAILED DESCRIPTION OF THE EMBODIMENTS

Figure 1A:
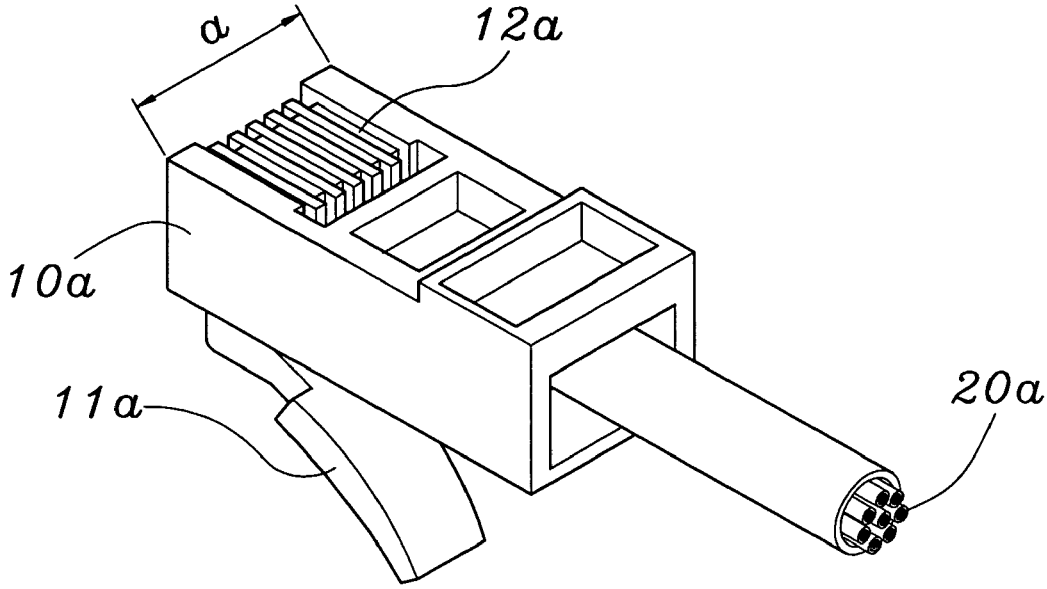
FIG. 1A PRIOR ART
FIG. 1A is a perspective view of a conventional plug according to one standard.
Figure 1B:
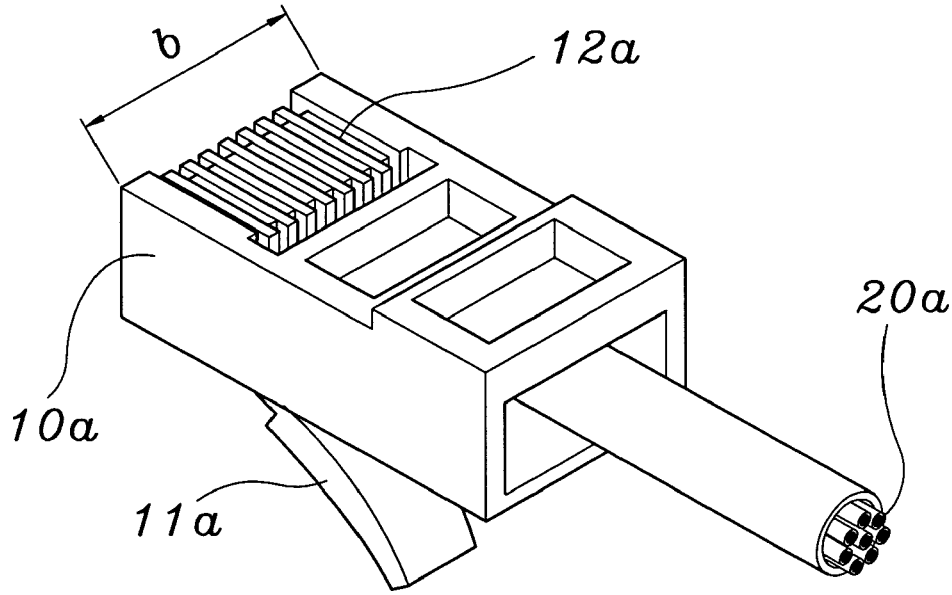
FIG. 1B PRIOR ART
FIG. 1B is a perspective view of a conventional plug according to another standard.
Figure 2:
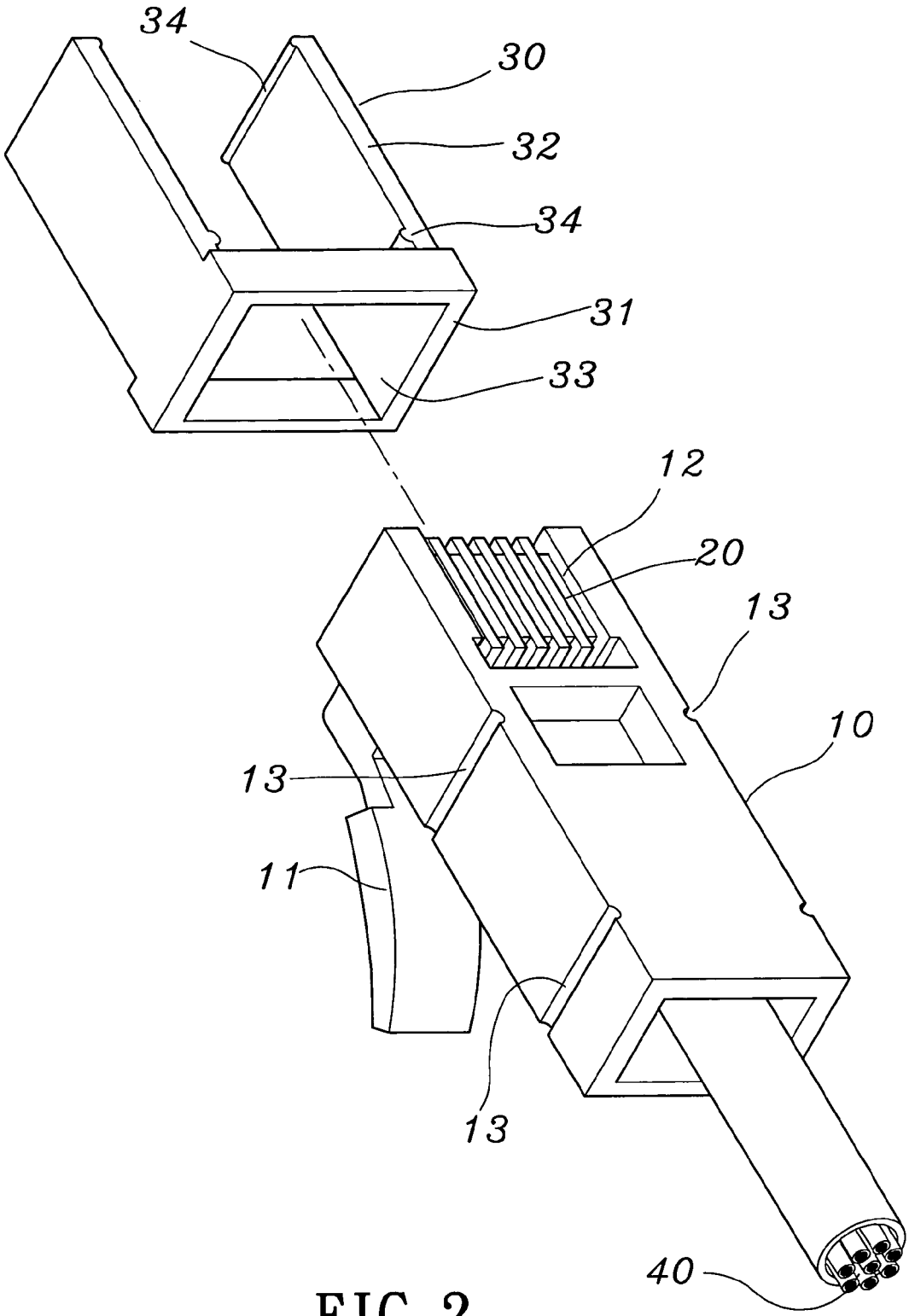
FIG. 2 is a decomposition view of a simple plug converter structure of the first embodiment according to the present invention.
Figure 3:
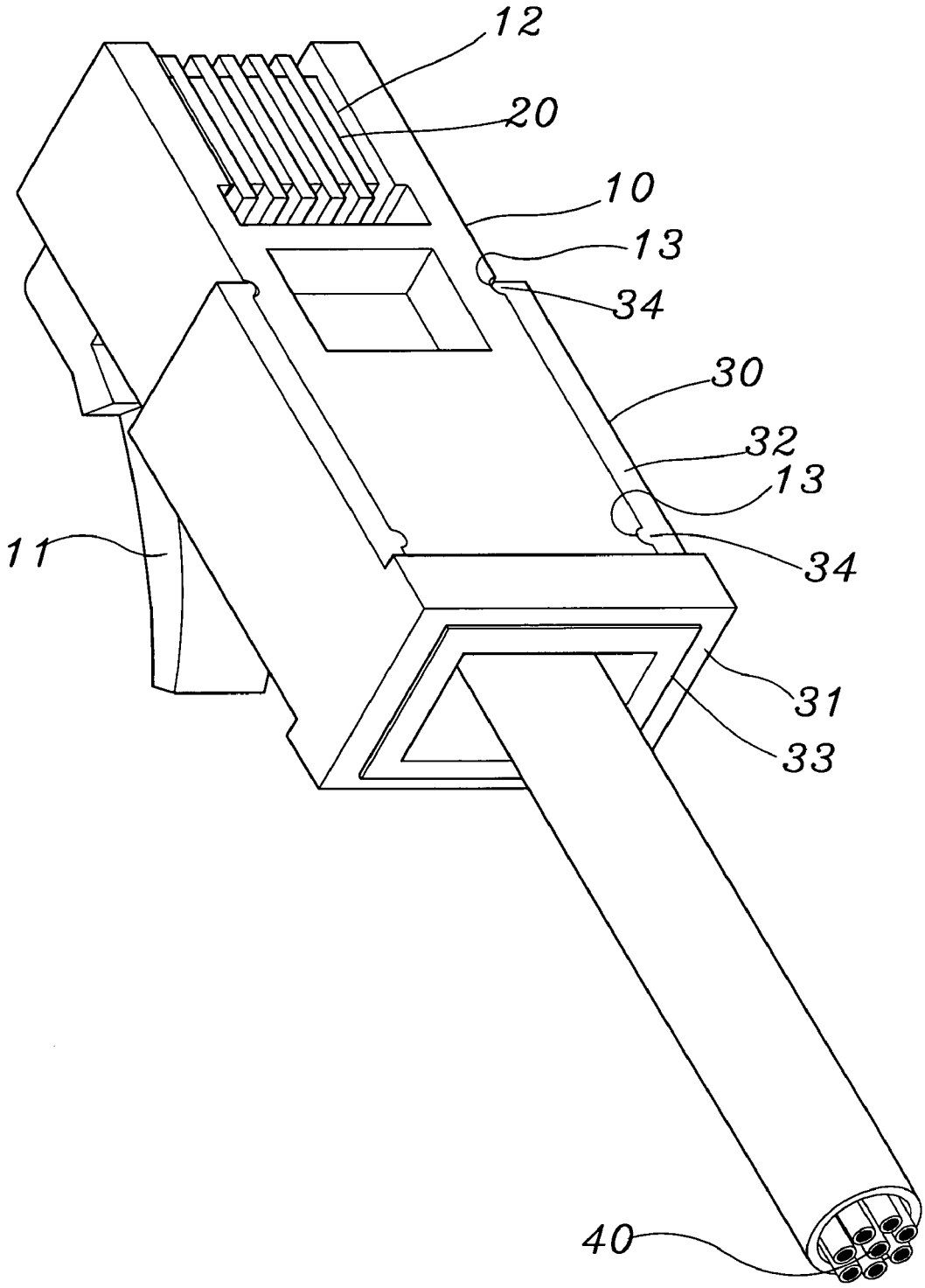
FIG. 3 is a perspective view of the simple plug converter structure of the first embodiment according to the present invention.

With respect to FIGS. 2 and 3, a preferred embodiment of the present invention is disclosed with a simple plug converter structure, which includes an insulative housing 10, a plurality of contacts 20 received in the slots respectively and a convertible member 30. The insulative housing 10 is made of shielding materials, such as plastic. The insulative housing 10 is hollow inside and has an attached member 11 disposed at an external surface thereof for clamping and orientating. The insulative housing 10 has a plurality of slots 12 formed at a front thereof. The slots 12 are arranged equidistantly and their number is not limited by the design. The slots 12 communicate with the hollow inside of the insulative housing 10. The insulative housing 10 can be provided with two limit slots 13 formed at a rear and a middle of each lateral side in order to orientate the convertible member 30.

The contacts 20 are made of conductive materials, such as copper. The contacts 20 are respectively received inside the slots 12. Each of the contacts 20 has a sharp end to pierce a wire 40 for electrical connection. The quantity of the contacts 20 is not restricted.

The convertible member 30 is made of isolation materials, such as plastics. The convertible member 30 includes a base 31 and two lateral sidearms 32 connected to the base 30. The base 31 is a rectangular parallelepiped approximately, and the width of the base 31 is larger than that of the insulative housing 10. The base 31 has a window 33 to sleeve onto the insulating housing 10. The two sidearms 32 are made integrally from the base 31 in one piece. Each sidearm 32 includes two secure protrusions 34 protruding inwardly and formed at a rear and a front thereof, so as to engage with the limit slots 13 of the rear or the middle of each lateral side of the insulative housing 10.

Figure 4:
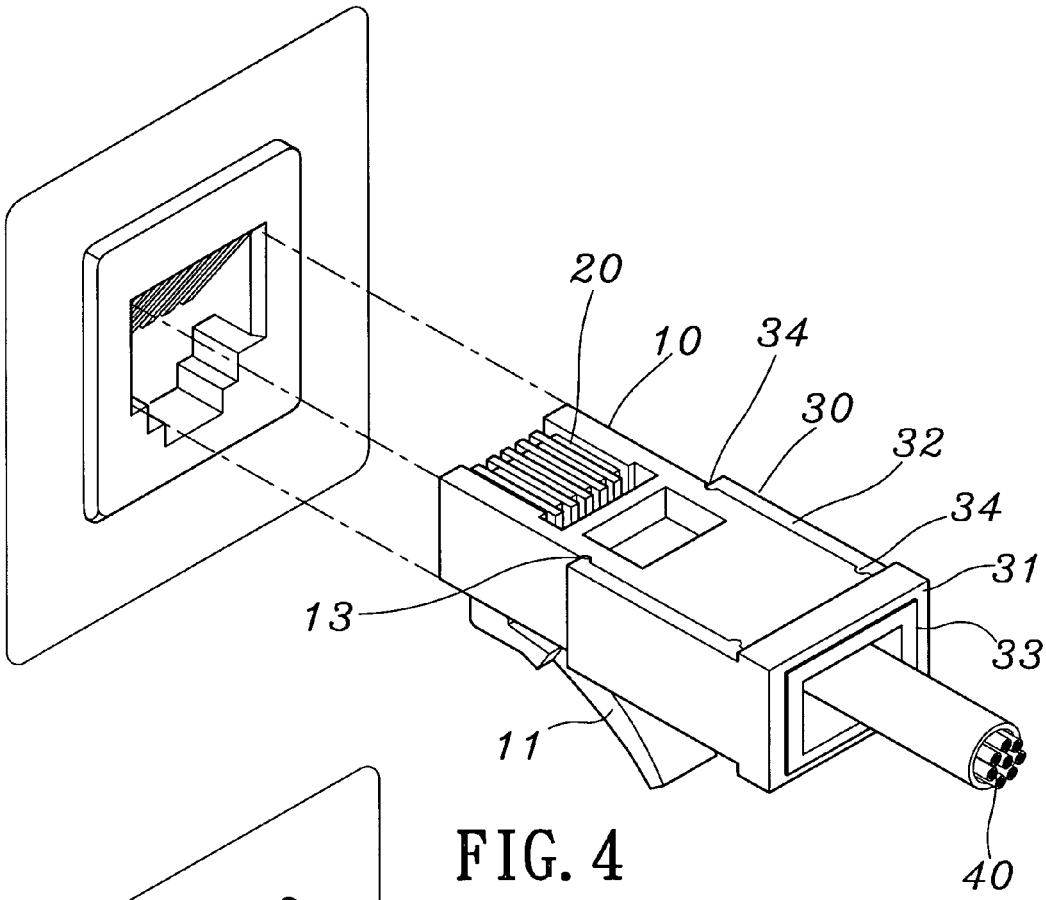
FIG. 4 is a perspective view of the simple plug converter structure of the first embodiment in use according to the present invention.

The convertible member 30 connects to the insulative housing 10 via the window 33. The convertible member 30 is movable relative to the insulative housing 10 between a first position and a second position thereof. When the convertible member 30 is pushed backwards to sit at the first position (shown in FIGS. 3 and 4), the secure protrusions 34 of each sidearm 32 engages the limit slots 13 at the rear and the middle of each lateral side to make an orientation mechanism, thus the convertible member 30 can connect firmly to the rear of the insulative housing 10.

Figure 5:
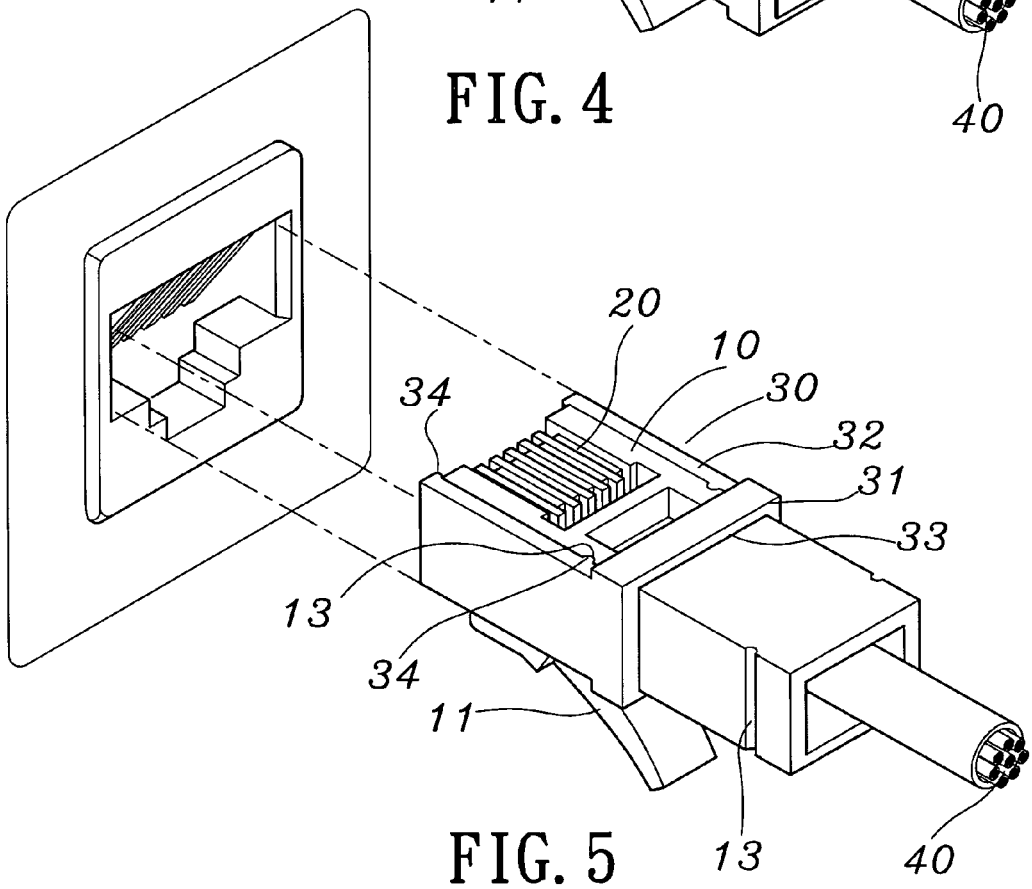
FIG. 5 is a perspective view of the simple plug converter structure of the first embodiment in use according to another application of the present invention.

When the convertible member 30 is pushed forwards to locate at the second position (shown in FIG. 5), the secure protrusion 34 of each sidearm 32 engages the limit slots 13 at the middle of each lateral side and a front of each lateral side simultaneously, thus the convertible member 30 can connect to the front of the insulative housing 10 firmly. Therefore, the convertible member 30 can be pushed forwards and backwards to alter the standard of the plug converter structure.

The conductive wires 40 penetrate through the rear of the insulative housing 10 and are pierced by the contacts 20 respectively for electrical connection. Therefore, the plug converter structure connects with the conductive wires 40 electrically.

According to the present invention, the insulative housing 10 is sleeved onto the convertible member 30, and the convertible member 30 can be moved as required. The convertible member 30 sits at the first position so that the plug converter structure is formed as a smaller one to mate with its relative socket (illustrated in FIG. 4); while the convertible member 30 sits at the second position so that the plug converter structure is bigger in order to match the other socket (illustrated in FIG. 5).

Hence, the simple plug converter structure can be used with two standards (a bigger one and a smaller one) with a single sized insulative housing 10, to save on manufacturing costs and to simplify the conversion processes.

Figure 6:
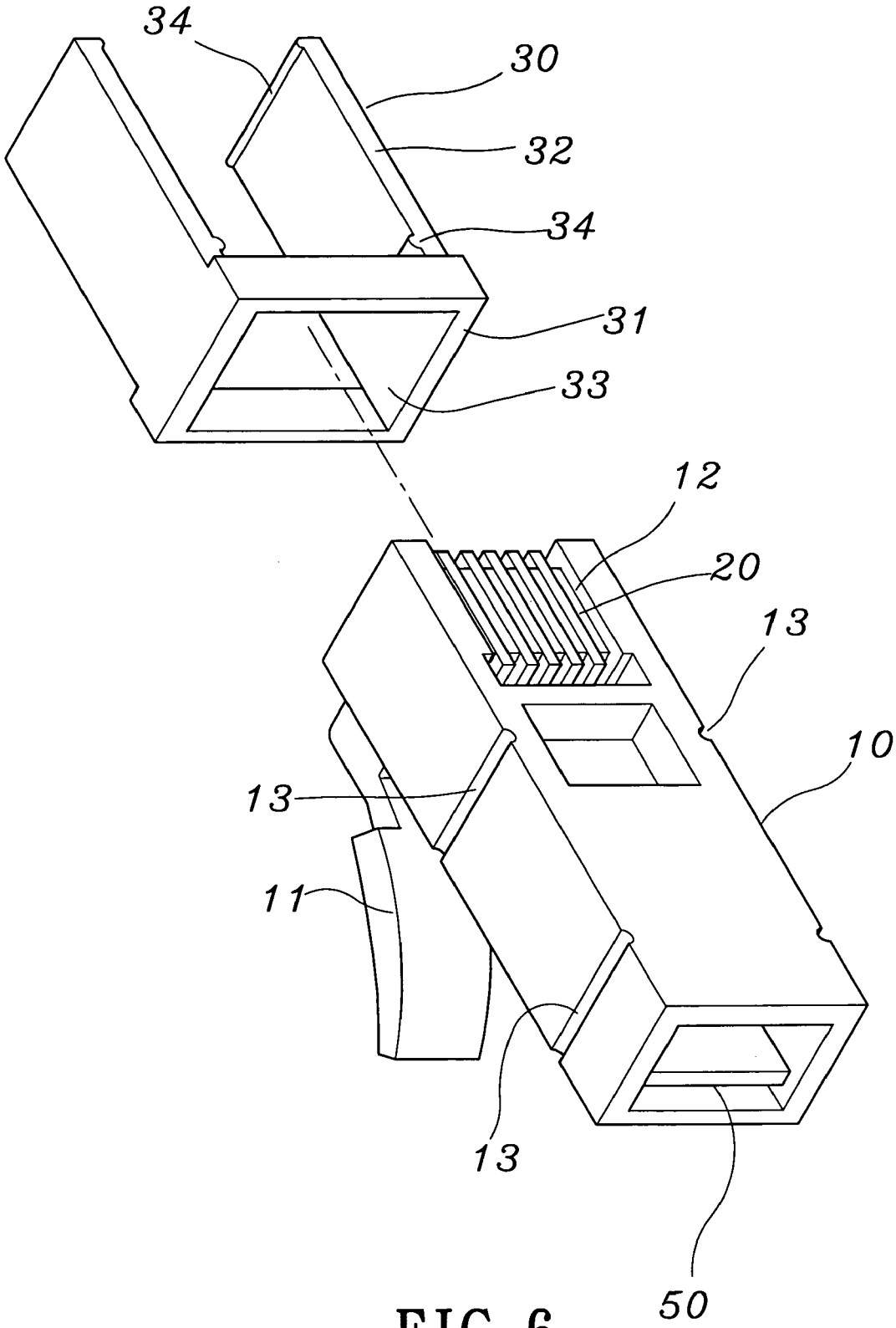
FIG. 6 is a decomposition view of the simple plug converter structure of the second embodiment according to the present invention.
Figure 6A:
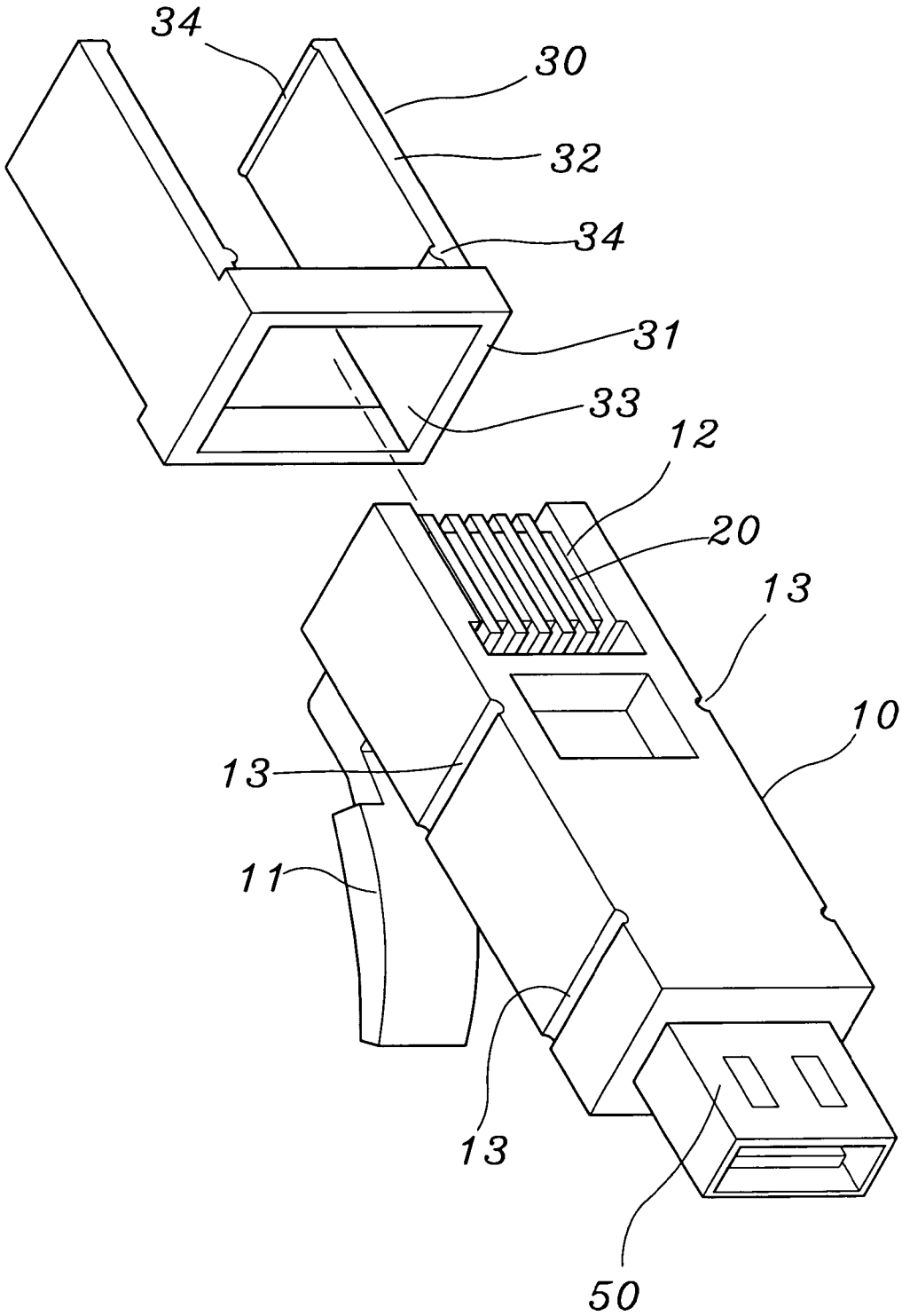
FIG. 6A is a decomposition view of the simple plug converter structure of the first embodiment according to another application of the present invention.
Figure 7:
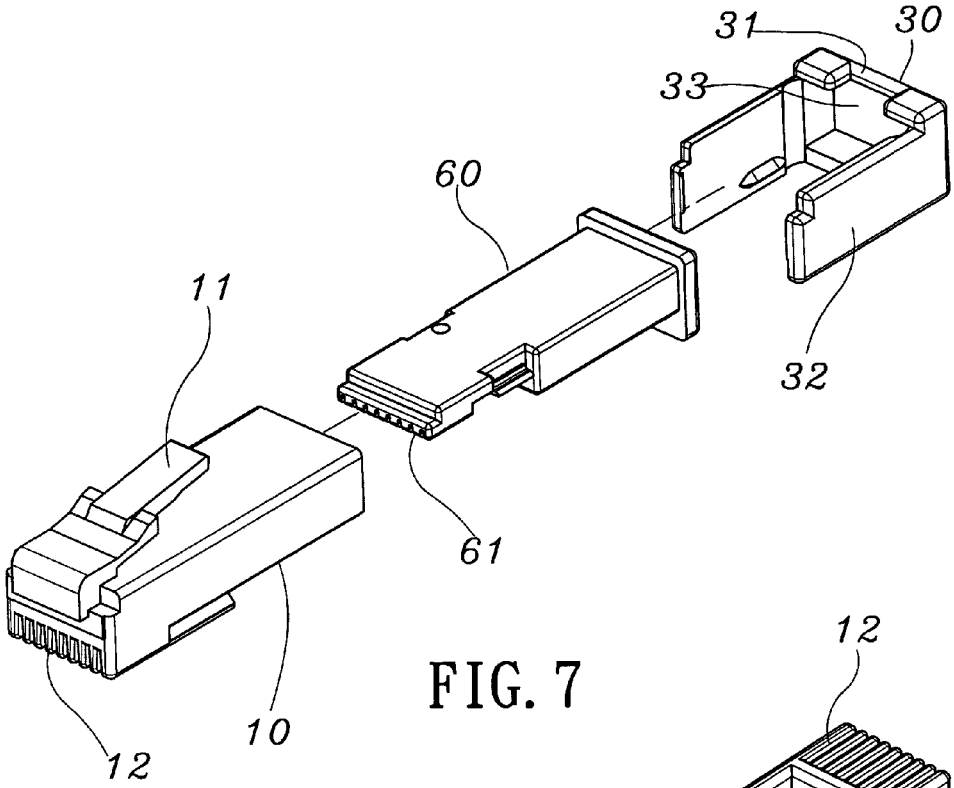
FIG. 7 is a decomposition view of the simple plug converter structure of the third embodiment according to the present invention.
Figure 8:
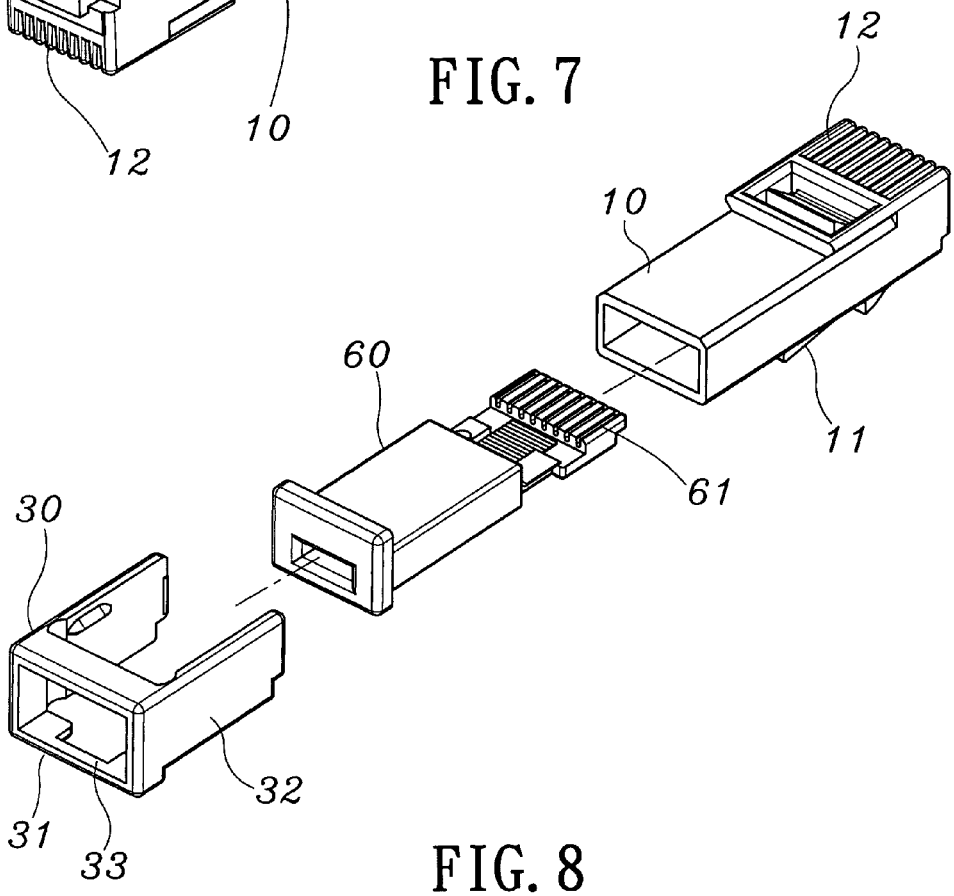
FIG. 8 is a decomposition view of the simple plug converter structure of the third embodiment from another angle according to the present invention.
Figure 9:
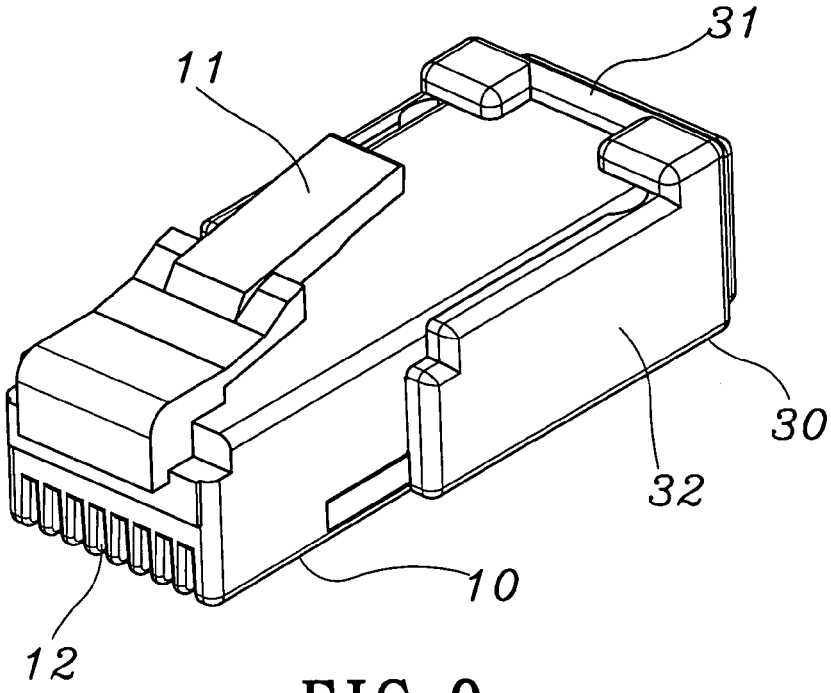
FIG. 9 is a perspective view of the simple plug converter structure of the third embodiment according to the present invention.
Figure 10:
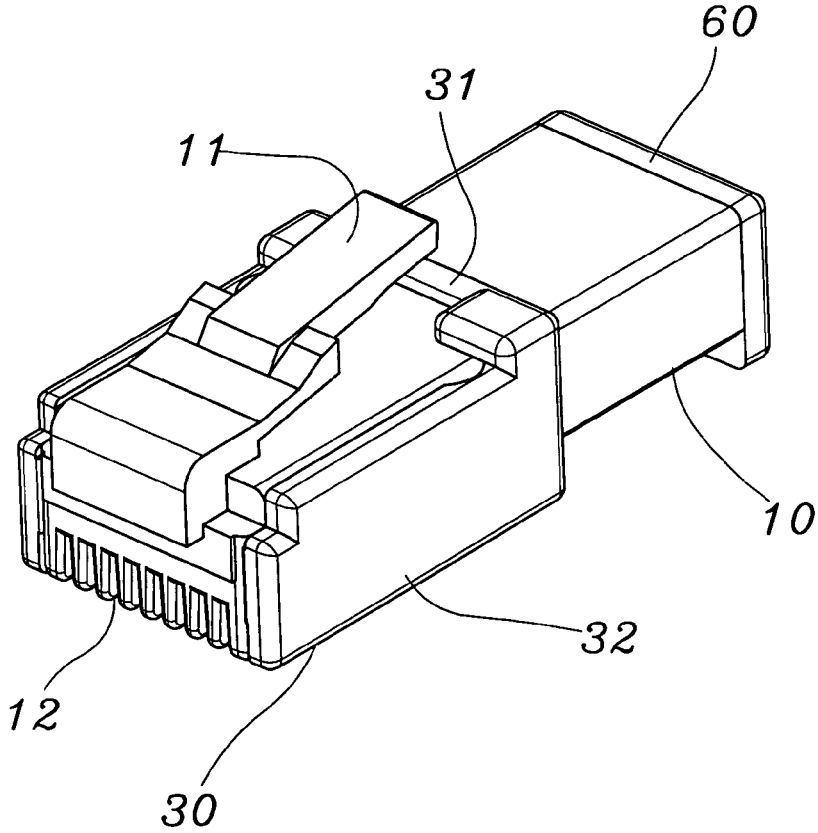
FIG. 10 is a perspective view of the simple plug converter structure of the third embodiment in use according to another application of the present invention.
Figure 11:
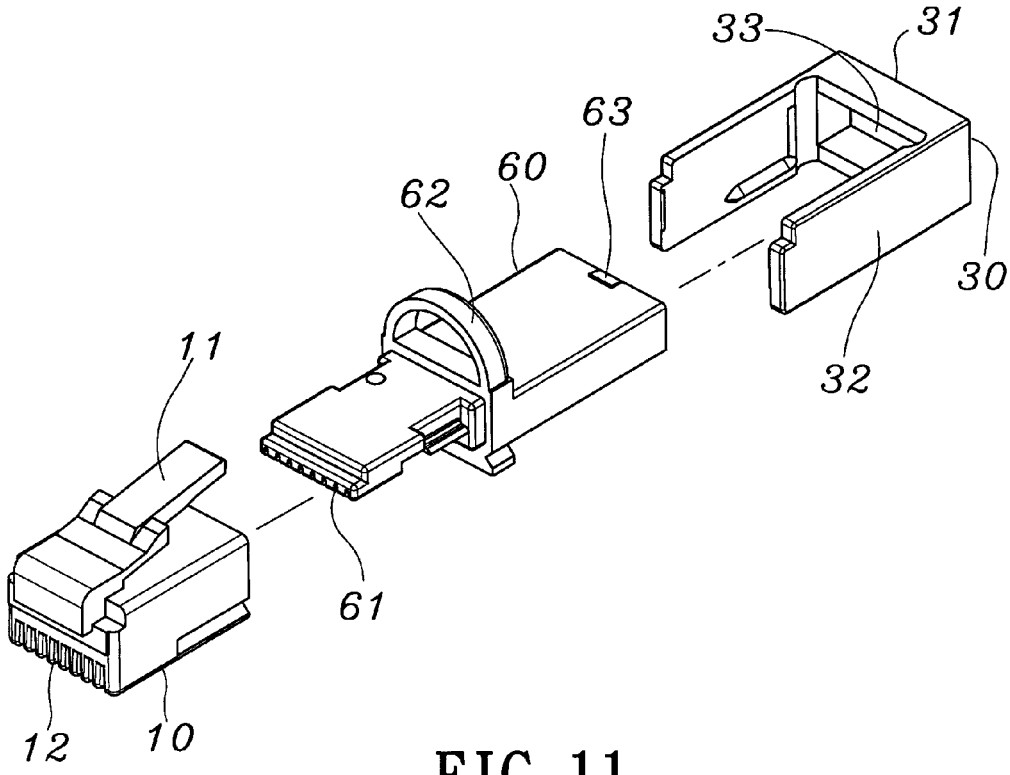
FIG. 11 is a decomposition view of the simple plug converter structure of the fourth embodiment according to the present invention.
Figure 12:
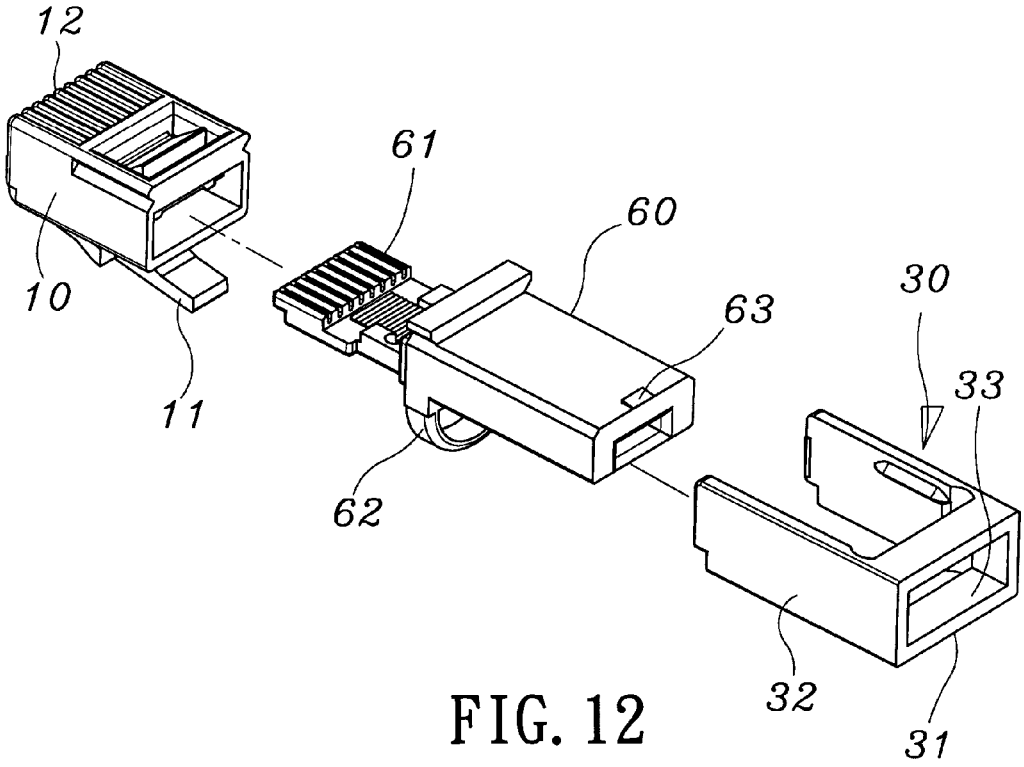
FIG. 12 is a decomposition view of the simple plug converter structure of the fourth embodiment from another angle according to the present invention.
Figure 13:
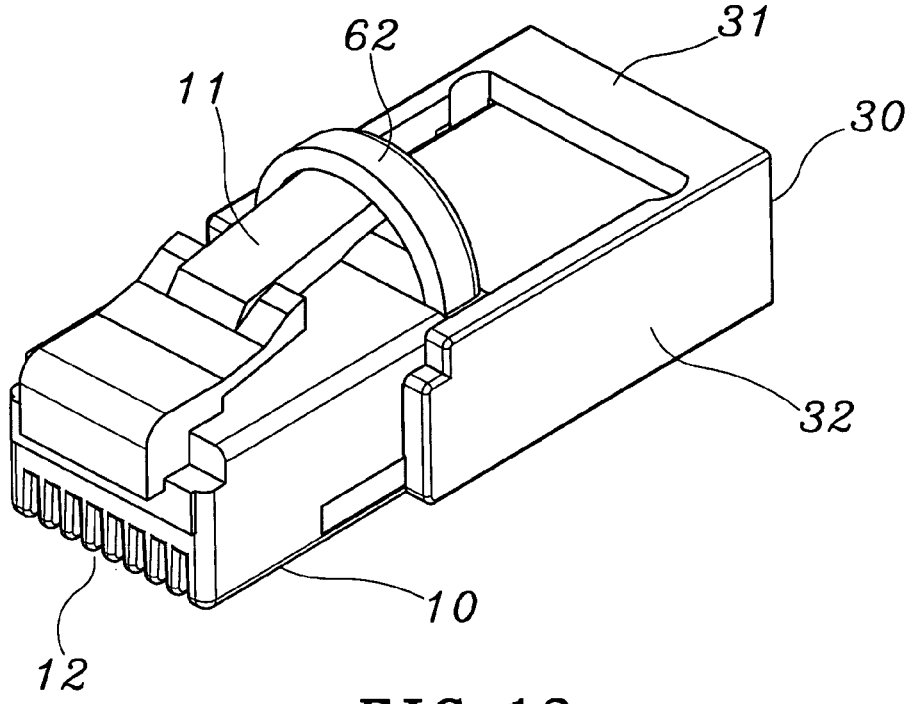
FIG. 13 is a perspective view of the simple plug converter structure of the fourth embodiment according to the present invention.
Figure 14:
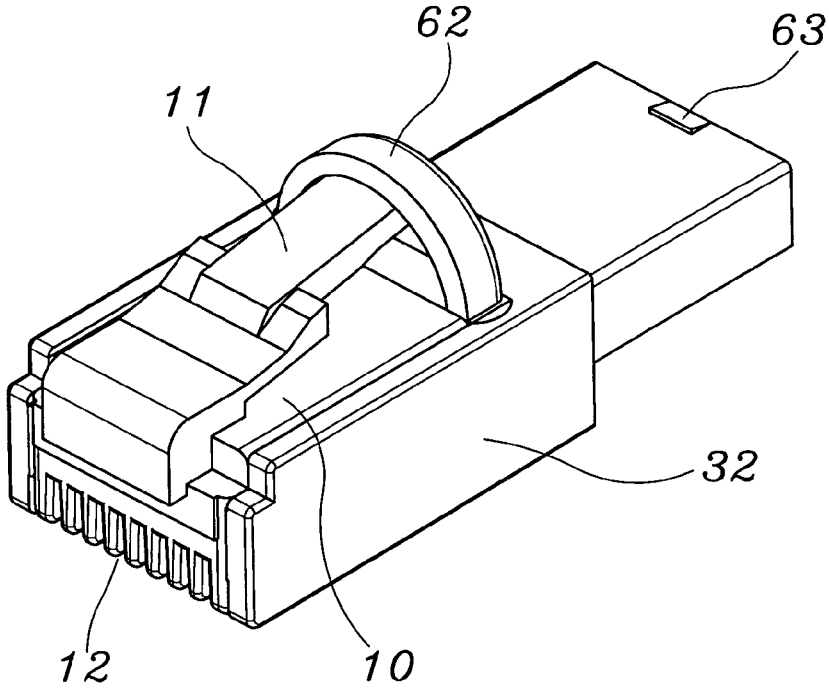
FIG. 14 is a perspective view of the simple plug converter structure of the fourth embodiment in use according to another application of the present invention.

In addition, FIG. 6 shows a USB connector 50 disposed at a rear thereof to electrically connect to the contacts 20. The USB connector 50 can be a convertible member. The USB connector may be provided in a male type illustrated in FIG. 6A or in a female type shown inn FIG. 6. Other connectors, plugs or sockets can replace the USB connector 50 for various purposes.

Furthermore, in regards to FIGS. 7 to 10, the configurations and the structures of the insulative housing 10 and the convertible member 30 can vary for mating with each other. The point is that the convertible member 30 should be moved between the first position and the second position (in FIGS. 9 and 10). A connection member 60, which includes wires (not shown) arranged inside and a plurality of slits 61 formed in a front thereof, is further provided and made of insulative materials. The wires are received in the slit 61 by penetrating from a rear of the connection member 60, the connection member 60 inserts inside the insulative housing 10 from the rear thereof, and the wires are secured inside the insulative housing 10 via the connection member 60 for electrically connecting to the contacts 20, which pierce the wires.

The configurations and the structures of the insulative housing 10 and the convertible member 30 can vary for mating each other according to various embodiments illustrated in FIGS. 11 to 14. The connection member 60 includes a protection sheath 62 connected thereof. The protection sheath 62 sleeves onto the attached member 11 while the connection member 60 connects with the insulative housing 10 so that the attached member 11 can be protected from damage in the event of a collision or breakage, and the service life of the whole plug converter structure will be prolonged. The connection member 60 has an orientation bulge 63 formed at the rear thereof to abut against the convertible member 30 while the convertible member 30 locates at the first position.

Figure 15:
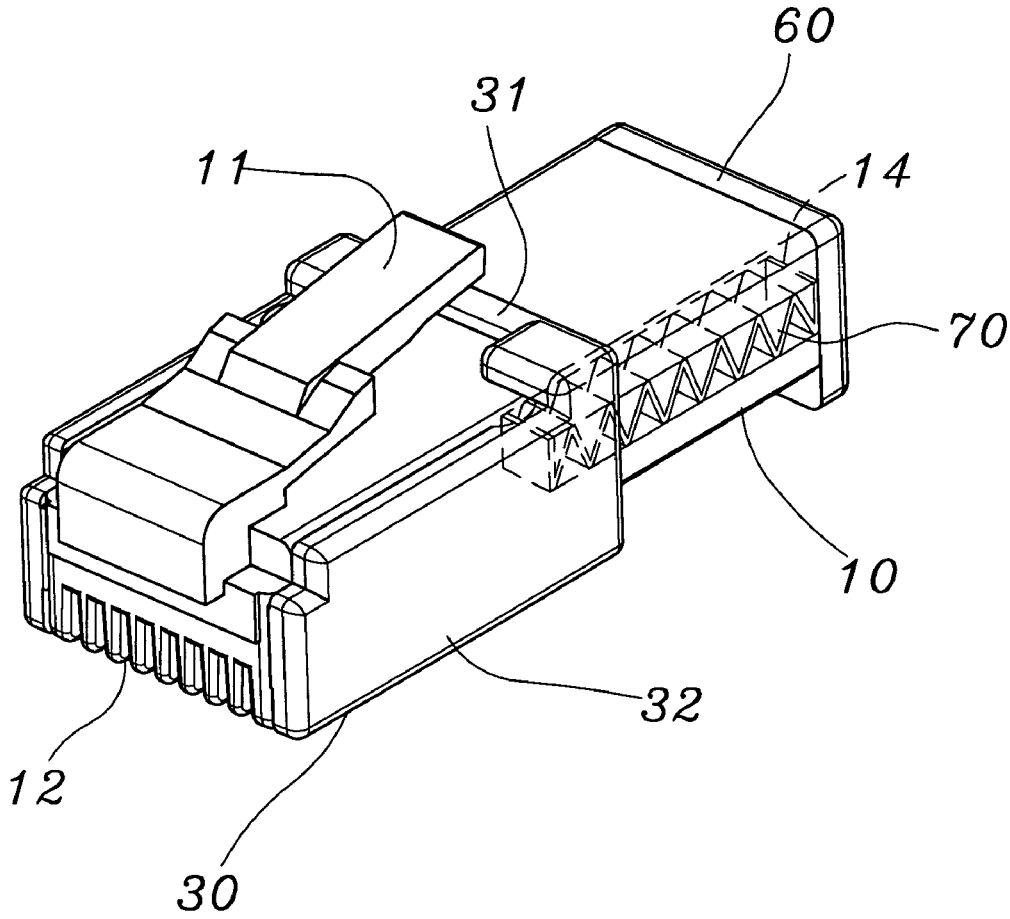
FIG. 15 is a perspective view of the simple plug converter structure of the fifth embodiment according to the present invention.

FIG. 15 is illustrated with a reception slot 14 formed at each lateral side of the insulative housing 10. A resilient member 70 is arranged inside the reception slot 14, and the resilient member 70 abuts against the insulative housing 10 and the convertible member 30 at two ends thereof, so that the convertible member 30 can be sleeved onto the insulative housing 10 flexibly for movements.

For the smaller standard socket, the convertible member 30 is abutted against the socket and is further pushed backwards to the first position spontaneously while the plug converter structure inserts into the socket. After drawing back from the smaller standard socket, the convertible member 30 can be carried by the insulative housing 10 and received into the socket, the resilient member 70 forces the convertible member 30 forwards to the second position for matching the bigger standard socket.

Figure 16:
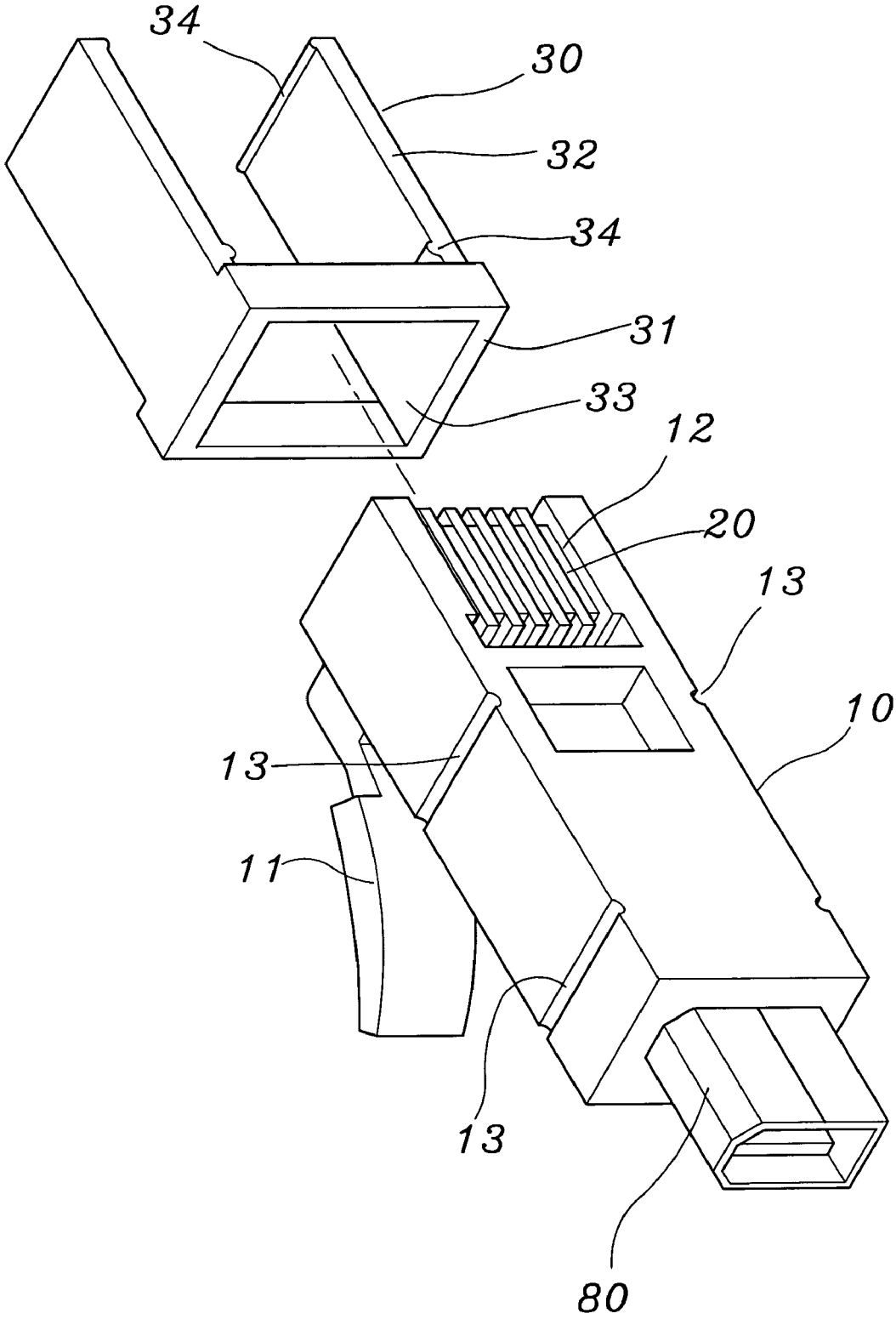
FIG. 16 is a decomposition view of the simple plug converter structure of the sixth embodiment according to the present invention.

FIG. 16 shows a connector 80, which obeys the IEEE 1394 standard. The contacts 20 electrically connect to the connector 80, and the connector 80 is treated as a convertible member.

Figure 17:
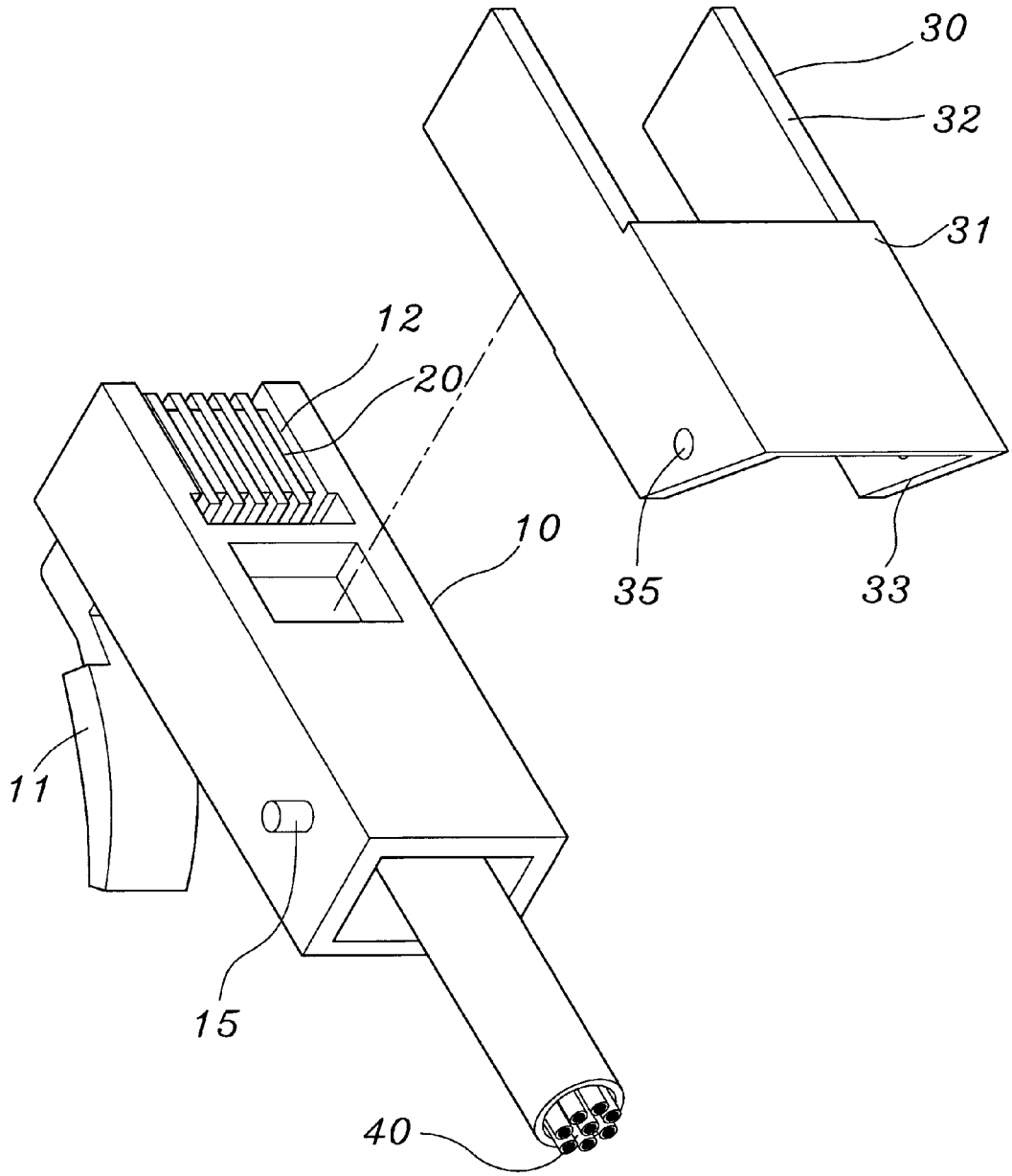
FIG. 17 is a decomposition view of the simple plug converter structure of the seventh embodiment according to the present invention.
Figure 18:
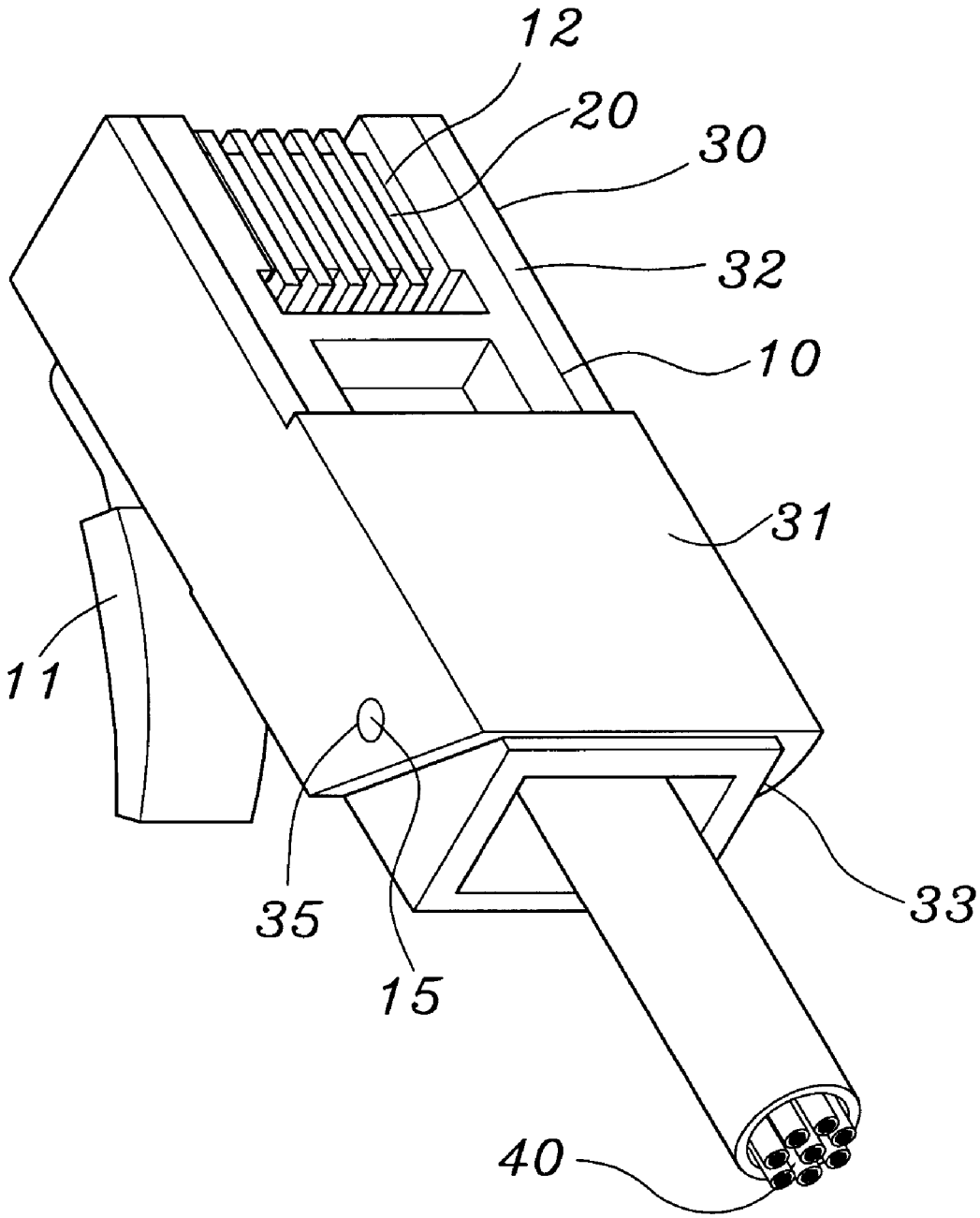
FIG. 18 is a perspective view of the simple plug converter structure of the seventh embodiment according to the present invention.

FIGS. 17 and 18 show how the convertible member 30 can pivotally connect with the insulative housing 10. The convertible member 30 has a first pivot portion 35 concaved at a rear of each lateral side thereof, the insulative housing 10 has a second pivot portion 15 protruding from the rear of each lateral side thereof to correspond to the first pivot portion 35, so that the convertible member 30 can be pivoted to the insulative housing 10 by lifting and covering.

For the smaller standard socket, the convertible member 30 can be lifted so that only the insulative housing 10 is inserted into the smaller standard socket. When the plug converter structure goes with the bigger standard socket, the convertible member 30 is covered by the insulative housing 10 and both are inserted into the bigger standard socket.

Figure 19:
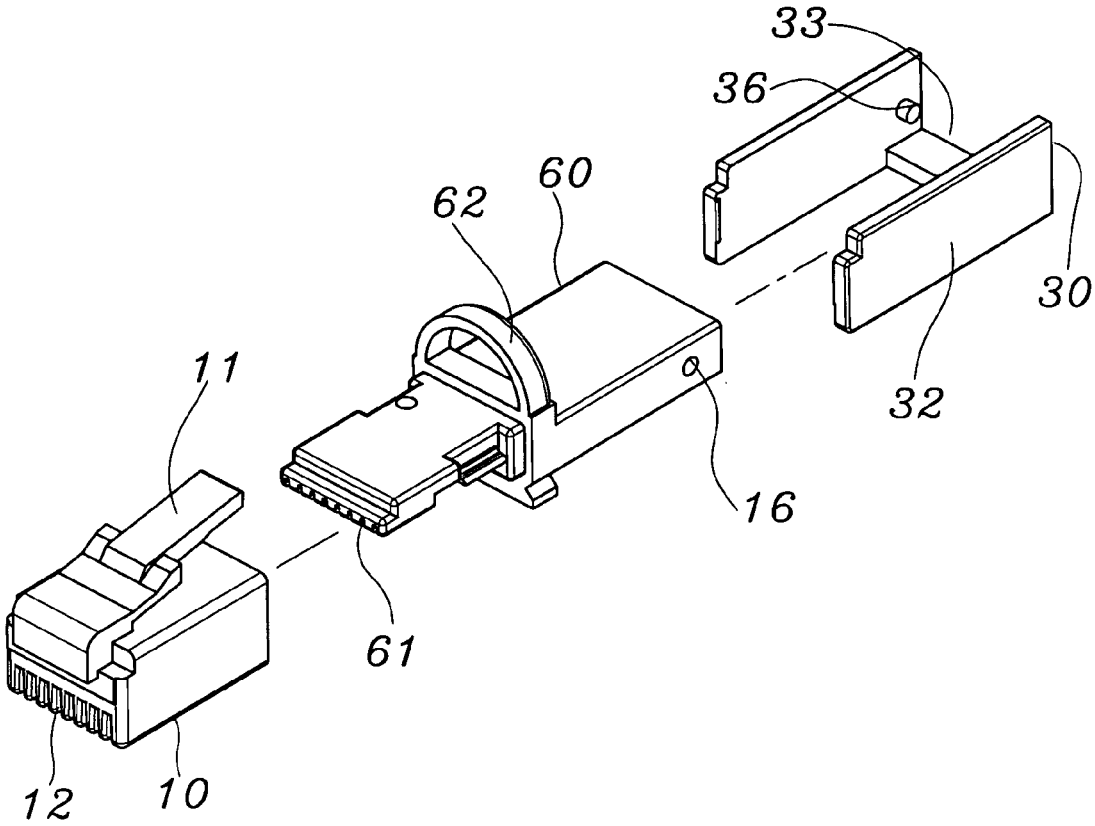
FIG. 19 is a decomposition view of the simple plug converter structure of the eighth embodiment according to the present invention.

A third pivot portion 36 illustrated in FIG. 19 is formed at the rear of each lateral side of the convertible member 30 and is convex. A fourth pivot portion 16 is formed on a rear of each lateral side of the connection member 60 and is indented relatively to the third pivot portion 36. Therefore, the convertible member 30 can be lifted by pivoting to the connection member 60.

Figure 20:
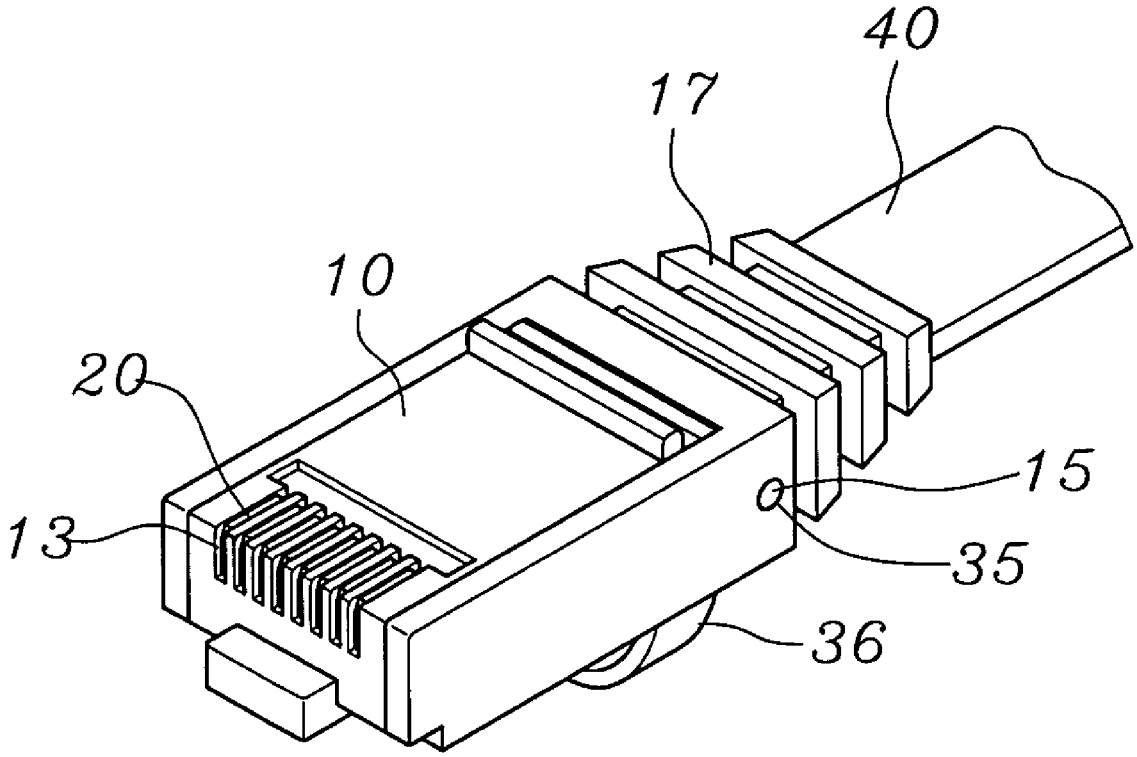
FIG. 20 is a perspective view of the simple plug converter structure of the ninth embodiment according to the present invention.

FIG. 20 shows the conductive wires 40 in a flap type, a conjunction portion 17 is arranged between the conductive wires 40 and the insulative housing 10 and made integrally into one piece.

It should be apparent to those skilled in the art that the above description is only illustrative of specific embodiments and examples of the invention. The invention should therefore cover various modifications and variations made to the herein-described structure and operations of the invention, provided they fall within the scope of the invention as defined in the following appended claims.

What is claimed is:

1. A simple plug converter structure comprising:

an insulative housing having a plurality of slots formed at a front thereof;

a plurality of contacts received in the slots respectively; and a convertible member pivotally mounted on the insulative housing at opposing side surfaces thereof, the convertible member having a pair of side arms in facing opposition one with the other, the convertible member being selectively pivotable into a first position and a second position, wherein the first position locates the side arms into contact with the opposing side surfaces of the insulative housing at the front thereof to engage into an opening of a first socket and the second position removes the side arms from the opposing side surfaces of the insulative housing at the front thereof to engage into an opening of a second socket;

wherein the opening of the second socket is smaller than the opening of the first socket.

2. The simple plug converter structure as claimed in claim 1, wherein the convertible member has formed on a rear thereof respective first pivot portions and the insulative housing has formed on the opposing side surfaces thereof respective second pivot portions, said first pivot portions being engaged with said second pivot portions such that the convertible member is pivotally mounted to the insulative housing thereat.

3. The simple plug converter structure as claimed in claim 2, wherein the first pivot portions of the convertible member are pivot holes and the second pivot portions of the insulative housing are pivot rods respectively mating with the pivot holes.

* * * * *